US006170413B1

(12) United States Patent
Hirose

(10) Patent No.: US 6,170,413 B1
(45) Date of Patent: Jan. 9, 2001

(54) CORRECTION APPARATUS FOR SEWING DATA AND CORRECTION METHOD

(75) Inventor: Hirokazu Hirose, Chiryu (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/604,075

(22) Filed: Jun. 27, 2000

(30) Foreign Application Priority Data

Jul. 12, 1999 (JP) ..... 11-196994

(51) Int. Cl.[7] ..... D05B 21/00; D05C 5/02

(52) U.S. Cl. ..... 112/102.5; 112/475.19; 112/475.11; 700/138

(58) Field of Search ..... 112/102.5, 475.11, 112/475.19, 470.06, 63, 103, 155, 309, 318, 322; 700/138

(56) References Cited

U.S. PATENT DOCUMENTS 5,873,314 * 2/1999 Gamano ..... 112/66
5,884,572 * 3/1999 Kawaguchi ..... 112/103
6,098,559 * 8/2000 Hirose ..... 112/475.19

* cited by examiner

*Primary Examiner*—Peter Nerbun
(74) *Attorney, Agent, or Firm*—Oliff & Berridge, PLC

(57) ABSTRACT

A correction apparatus is designed to correct sewing data used on a sewing machine that forms an embroidery pattern on a cap by moving a needle bar upward and downward and a frame holding the cap in the X- and Y-axis directions. In the correction apparatus for correcting sewing data, the correction apparatus first reads sewing data as an original data, then finds the coordinates of a stitch point for each stitch from the read original data. The correction apparatus corrects the X coordinate of the stitch point based on a correction value that varies according to the Y coordinate, to create an execution data different from that in the original data. The correction value is calculated using the coordinate data of the Y-axis direction as a variable and a correction parameter that can be changed as a constant. As a result, the use of the corrected sewing data enables the sewing machine to form an embroidery pattern on the cap as the same as the original data indicates, unaffected by the shape of the cap and the different movement amounts between the crown side and the visor side of the cap.

16 Claims, 9 Drawing Sheets

S: SEWING START POINT
N: Nth STITCH POINT BEFORE CORRECTION
N−1:(N−1)th STITCH POINT BEFORE CORRECTION

Fig. 5

| |
|---|
| COLOR CHANGE CODE |
| NEEDLE NUMBER BEFORE NEEDLE CHANGE |
| NEEDLE NUMBER AFTER NEEDLE CHANGE |
| FEED CODE |
| X MOVEMENT AMOUNT |
| Y MOVEMENT AMOUNT |
| STITCH CODE |
| X MOVEMENT AMOUNT |
| Y MOVEMENT AMOUNT |
| STITCH CODE |
| X MOVEMENT AMOUNT |
| Y MOVEMENT AMOUNT |

⋮

| |
|---|
| STITCH CODE |
| X MOVEMENT AMOUNT |
| Y MOVEMENT AMOUNT |
| END CODE |
| DUMMY DATA |
| DUMMY DATA |

Fig.9
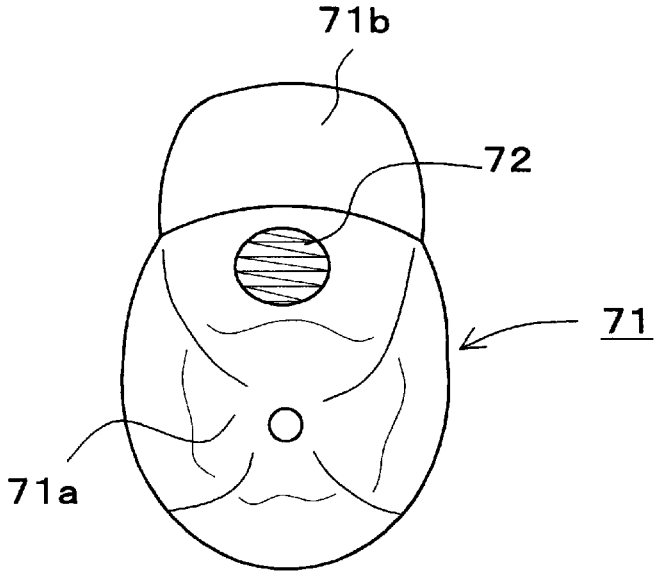
Fig.10 A
Fig.10 B
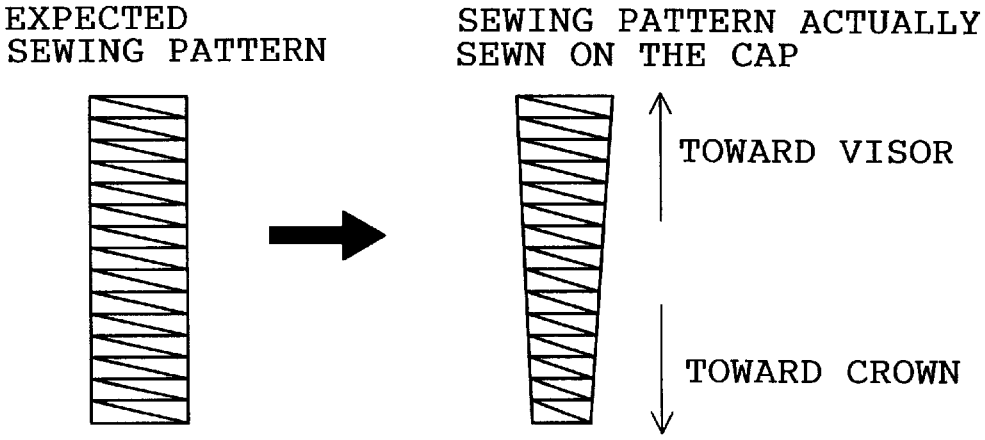

CORRECTION APPARATUS FOR SEWING DATA AND CORRECTION METHOD

BACKGROUND OF THE INVENTION

1. Field of Invention

The invention relates to a correction apparatus and correction method for sewing data to be used on a sewing machine that moves a needle bar upward and downward and a frame holding an object to be sewn in the X- and Y-axis directions to form a pattern on the object to be sewn.

2. Description of Related Art

There is a sewing machine that can form patterns on various kinds of objects to be sewn. For example, a sewing system for embroidering is designed to sew an embroidery pattern on a hat as an object to be sewn by moving a needle bar having a needle up and down and moving an attachment frame to which the hat is attached. The sewing system for embroidery comprises the attachment frame movable in the X- and Y-axis directions that cross each other, an actuator that drives the attachment frame, a needle bar movable upward and downward together with a needle, an actuator that drives the needle bar, and a controller that drives and controls each actuator. With regards to the attachment frame that holds a hat or cap, there are two types: one has two fixing portions that holds a hat both at a visor side and at a crown side; and the other has a single fixing portion that hold a hat only at a visor side. The controller, for example, drives and controls each actuator based on the sewing data read into an internal memory from an outside recording medium, to move the needle up and down and the attachment frame in the X and Y directions with the needle movement. To secure the movement amount in the X or Y direction, there is a structure in which the attachment frame is rotatable. Thus, as shown in FIG. 9, a specified embroidery pattern 72 is to be embroidered on a specified portion, e.g. the front, of a cap 71 attached to the attachment frame.

The controller processes the sewing data in accordance with a specified control program previously stored into the internal memory.

However, in the above-mentioned sewing system, the cap 71 is the main object to be sewn. The cap 71 has a substantially conical shape, and a diameter toward a crown side 71*a* is smaller than that toward a visor side 71*b*. Therefore, when the attachment frame is moved to move the cap 71, the movement amount toward the crown 71*a* tends to become smaller than that toward the visor 71*b*. In particular, the arrangement in which the attachment frame is rotated in conformity to the shape of the cap 71 is more likely to show this tendency. Therefore, when an embroidery pattern 72 is embroidered on the cap 71, the actual width of the pattern 72 becomes narrower in the direction from the visor side toward the crown side as shown in FIG. 10 (*b*), in contrast to an expected pattern as shown in FIG. 10 (*a*).

On the other hand, in the sewing system using the attachment frame that has only one fixing portion at the visor side 71*b* for fixing the cap 71, when the cap 71 is moved along with the attachment frame, there is a possibility that the movement toward the crown side 71*a* becomes smaller than that toward the visor side 71*b*. This case also includes the above problem that the actual width of the sewn pattern is not equal at the visor side 71*b* and the crown side 71*a*.

SUMMARY OF THE INVENTION

Accordingly, it is an object of the invention to provide a correction apparatus and a correction method for sewing data so that a pattern can be sewn as the sewing data indicates without changing the shape of the pattern, unaffected by the shape of the object to be sewn and the movement of the attachment frame.

A correction apparatus for sewing data to be used on a sewing machine that forms a pattern on an object to be sewn by moving a needle up and down and a frame to which the object is attached in an X- and Y-axis directions, comprises a first device that reads the sewing data as an original data, the sewing data including X-axis direction movement data and Y-axis direction movement data, a second device that calculates X-axis coordinate data and Y-axis coordinate data of each stitch point based on the original data, and a third device that corrects the X-axis coordinate data based on a correction value, the correction value varying according to the Y-axis coordinate data of the stitch point.

In the above described correction apparatus, the sewing data is read into the correction apparatus as an original data. The coordinates of each stitch point are calculated from the original data. The data in the X-axis direction is corrected based on a correction value that varies according to the data in the Y-axis direction, and an execution data different from the original data is created.

Therefore, for example, when the problem comes from a shape of the object to be sewn, the movement amount of the object in the X direction at the forefront of the Y direction may become smaller than that at the root of the Y direction. In this case, the formation of the execution data due to the correction as described above acts effectively. In addition, when the problem comes from a fixing method of the object to the frame and the object is moved along with the frame, the movement of the object at the forefront in the Y direction may become inferior to the movement at the root in the Y direction. In this case, the formation of the execution data due to the correction as described above acts effectively. Namely, the X coordinate of each stitch point found above is corrected based on the correction value, which enables substantially equal movement amounts in the X-direction at the forefront and the root of the Y direction and equal displacements at the forefront and the root of the Y direction with respect to the frame.

In an exemplary embodiment of the correction apparatus according to the invention, a correction apparatus for sewing data to be used on a sewing machine, including a bed, that forms a pattern on a cap in a direction from a visor side to a crown side by moving a needle up and down and an frame to which the cap is attached in an X- and Y-axis directions, comprises a first device that reads the sewing data as an original data, the sewing data including X-axis direction movement data and Y-axis direction movement data, the Y-axis being in a direction of the length of the bed and the X-axis direction being a rotating direction on the Y-axis, a second device that calculates X-axis coordinate data and Y-axis coordinate data of each stitch point based on the original data, and a third device that corrects the X-axis coordinate data based on a correction value, the correction value varying according to the Y-axis coordinate data of the stitch point.

According to the correction apparatus described above, for example, the cap is substantially conical, and the diameter at the crown side is smaller than that at the visor side. When the movement amount of the X direction at the crown side becomes smaller than that at the visor side, the formation of the execution data due to the correction as described above acts effectively. In addition, when the problem comes from a fixing method of the cap to the frame and the cap is moved along with the frame, the movement amount of the cap in the X direction at the crown side of the Y direction may become inferior to that at the visor side. In this case, the formation of the execution data due to the correction as described above acts effectively. That is, the X coordinate of each stitch point found above is corrected based on the correction value, which enables substantially equal movement amounts in the X-direction at the crown side and the visor side and equal displacements at the crown side and the visor side with respect to the frame.

In the correction apparatus, the correction value is calculated using the coordinate data of the Y-axis direction as a variable and a correction parameter that can be changed as a constant.

Thus, the correction value is changed as the coordinate data of the Y-axis direction is changed. The change ratio of the correction value is changed in accordance with the change of the correction parameter.

In another exemplary embodiment of the invention, a correction method for sewing data to be used on a sewing machine that forms a pattern on an object to be sewn by moving a needle up and down and a frame in an X- and Y-axis directions, comprises reading the sewing data as an original data, the sewing data including X-axis direction movement amount data and Y-axis direction movement amount data, calculating X-axis coordinate data and Y-axis coordinate data of each stitch point base on the original data, and correcting the X-axis coordinate data based on a correction value, the correction value varying according to the Y-axis coordinate data of the stitch point.

Thus, the execution data that is different from the original data is created. It is possible to substantially equalize the movement amount of the object in the X direction at the forefront of the Y direction and the movement amount of the object in the X direction at the root of the Y direction.

In another exemplary embodiment of the invention, a computer-readable recording medium stores a program to allow a computer to execute a correction method for sewing data to be used on a sewing machine that forms a pattern on an object to be sewn by moving a needle up and down and a frame to which the object is attached in an X- and Y-axis directions, the program comprising routines for reading the sewing data as an original data, the sewing data including X-axis direction movement data and Y-axis direction movement data, calculating X-axis coordinate data and Y-axis coordinate data of each stitch point based on the original data, and correcting the X-axis coordinate data based on a correction value, the correction value varying according to the Y-axis coordinate data of the stitch point.

Thus, the program stored in the recording medium is read into the computer and executed thereon. Therefore, the correction method for sewing data described above is carried out, thereby achieving the similar result

BRIEF DESCRIPTION OF THE DRAWINGS

Various exemplary embodiments of the invention will be described in greater detail with reference to the accompanying drawings wherein;

FIG. 5 is a concept figure showing of contents of sewing data to be stored in RAM;

FIG. 9 is a front elevation of a cap related to a prior art; and

FIG. 10(*a*) is a figure showing an embroidery pattern to be sewn on a cap and FIG. 10(*b*) is a figure showing the embroidery pattern actually sewn on the cap, both related to the prior art.

DETAILED DESCRIPTION OF PREFERRED EMBODIMENTS

Various exemplary embodiments of the invention will be described in detail with reference to the accompanying drawings. The invention will be described embodied in a sewing system for embroidery that embroiders a pattern on a front of a cap as an object to be sewn. Although the invention is described as embodied in an electronically controlled sewing machine having an embroidery device, it should be appreciated that the invention is applicable to an electronically controlled sewing machine having a pattern sewing or forming device that forms a pattern or patterns, for example, a buttonhole, using, for example, a utility stitch or a zig-zag stitch.

Figure 1:
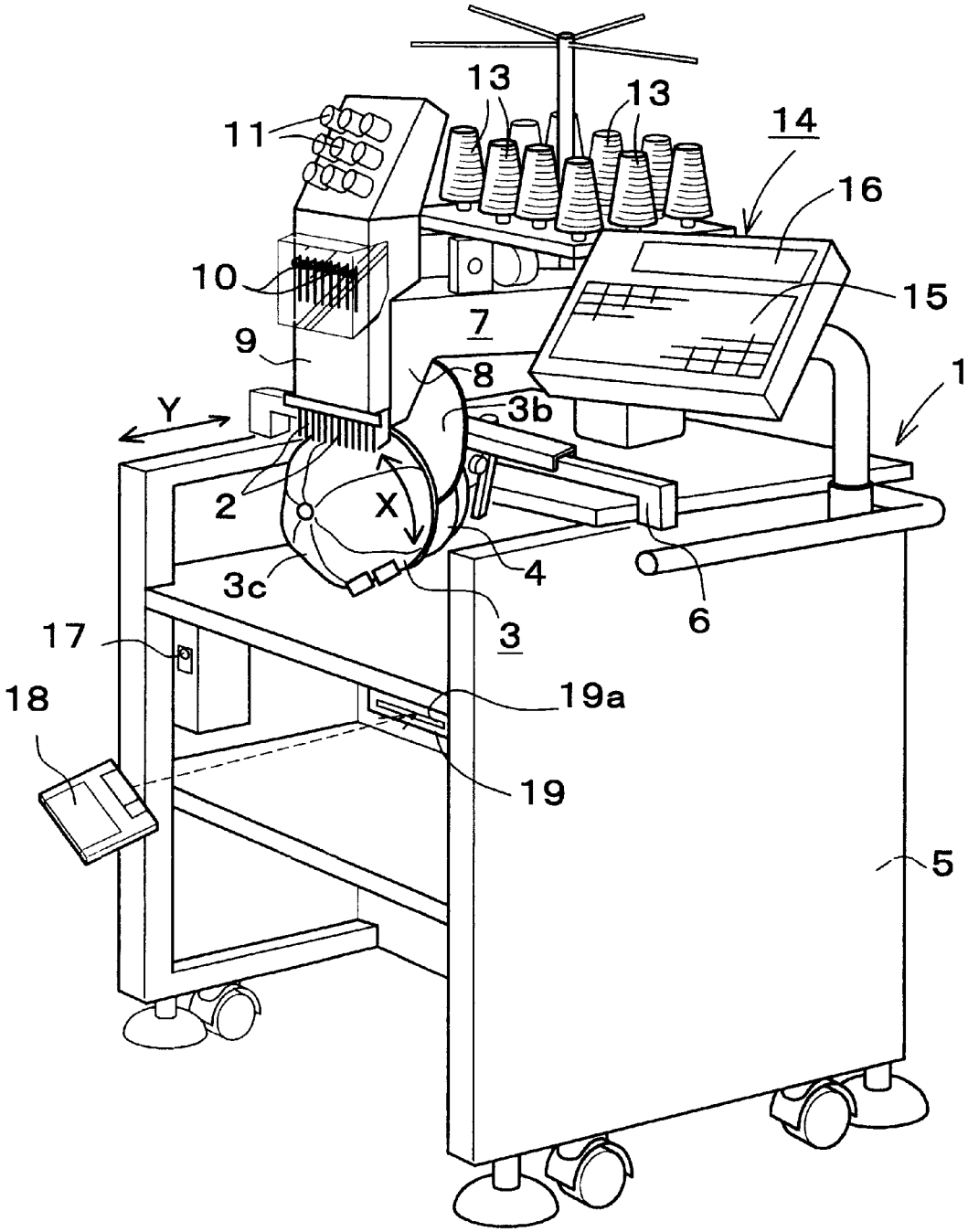
FIG. 1 is a perspective view of an exemplary embodiment of a sewing system for embroidery according to the invention.

FIG. 1 is a perspective view of a sewing system for embroidery 1 of the invention. The sewing system 1 is designed to embroider an embroidery pattern on a front of a cap 3 by moving a needle bar up and down and horizontally moving an attachment frame 4 holding the cap 3 as an object to be sewn. The sewing system 1 comprises a base frame 5, an X-Y carriage 6 provided thereon, and a sewing machine 7 provided on an upper part of the base frame 5. At a forefront of an arm 8 of the sewing machine 7, a needle bar case 9 containing a plurality of needle bars 2, a plurality of thread take-ups 10 corresponding to each of the needle bars 2, and a plurality of thread tension dials 11 corresponding to each of the thread take-ups 10 are provided. On a lower part of the arm 8, a bed (not shown) extending from the sewing machine 7 is provided. On an upper part of the arm 8, a plurality of spools 13 of thread corresponding to each of the needle bars 2 are provided.

An operation panel 14 is connected to the base frame 5. The operation panel 14 includes a keyboard 15 and a display 16. The keyboard 15 has a plurality of keys operated for setting or changing the control status of the sewing system 1, such as an embroidery key that sets embroidering, and a correction key to execute a correction program that corrects sewing data for embroidery. The display 16 displays a control status, an operation status, and necessary data for the sewing system 1. The operation panel 14 has a computer 41 (FIG. 4) serving as a controller to control the sewing system 1.

A power switch 17 to start the sewing system 1 is provided on the base frame 5. A floppy disk drive 19 to read what is stored in a floppy disk 18 as a recording medium, is also provided on the base frame 5. The floppy disk 18 is inserted into a slot 19*a* of the floppy disk drive 19, and the data stored in the floppy disk 18 becomes readable. The floppy disk 18 stores a control program to allow the computer 41 to execute sewing data. Another floppy disk 18 stores a correction program to allow the computer 41 to execute a correction method so as to correct the sewing data in accordance with the shape of the cap 3.

Figure 4:
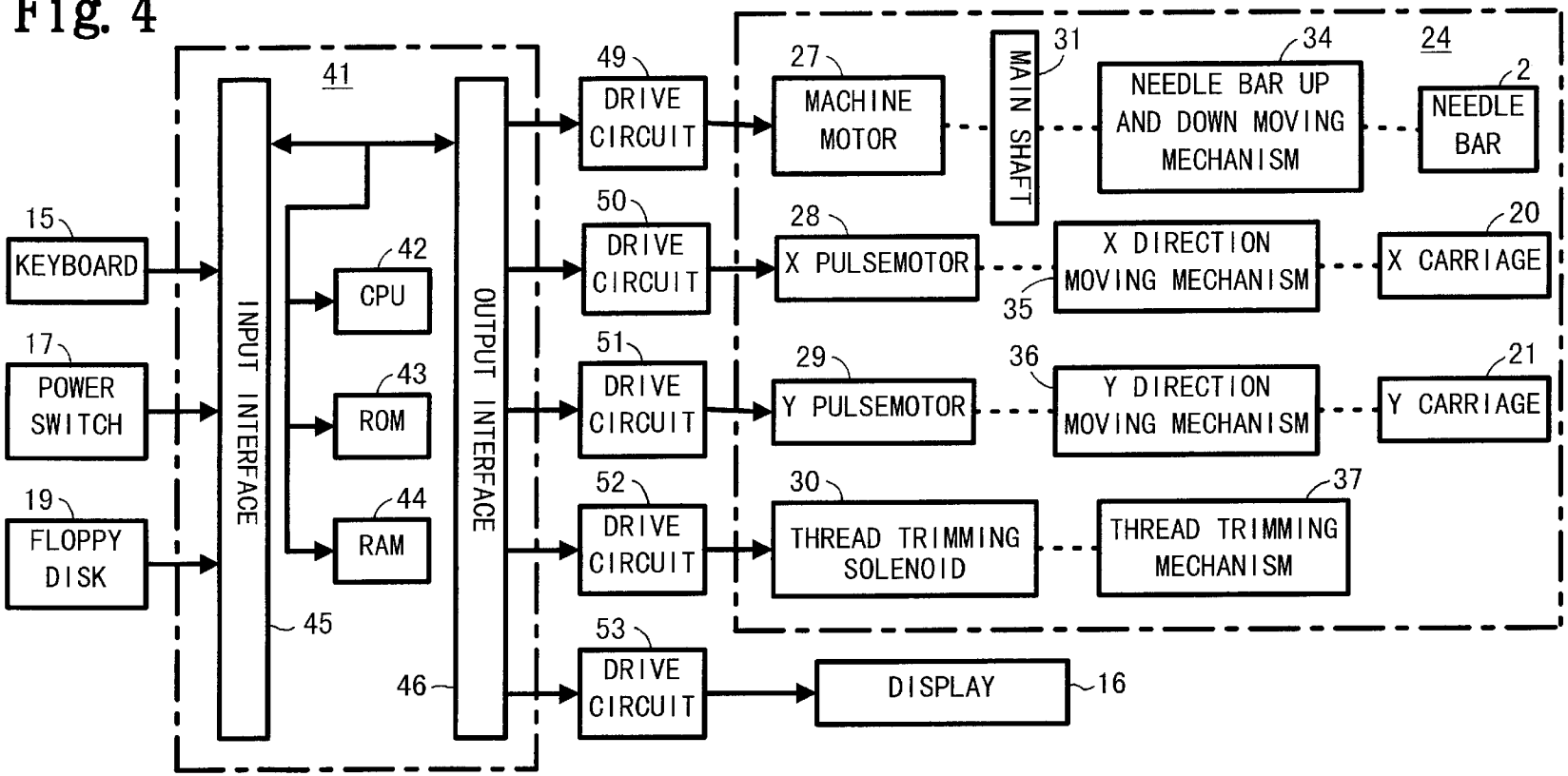
FIG. 4 is an exemplary embodiment of a control block diagram indicating mechanical and electrical structures of the sewing system.

The X-Y carriage 6 provided on the base frame 5 includes an X carriage 20 and a Y carriage 21 as shown in FIG. 4. The X carriage 20 moves the attachment frame 4 in the X direction that is perpendicular to the bed and arm 8. The Y carriage 21 moves the attachment frame 4 in the Y direction that is the direction of the length of the bed and the arm 8.

Figure 2:
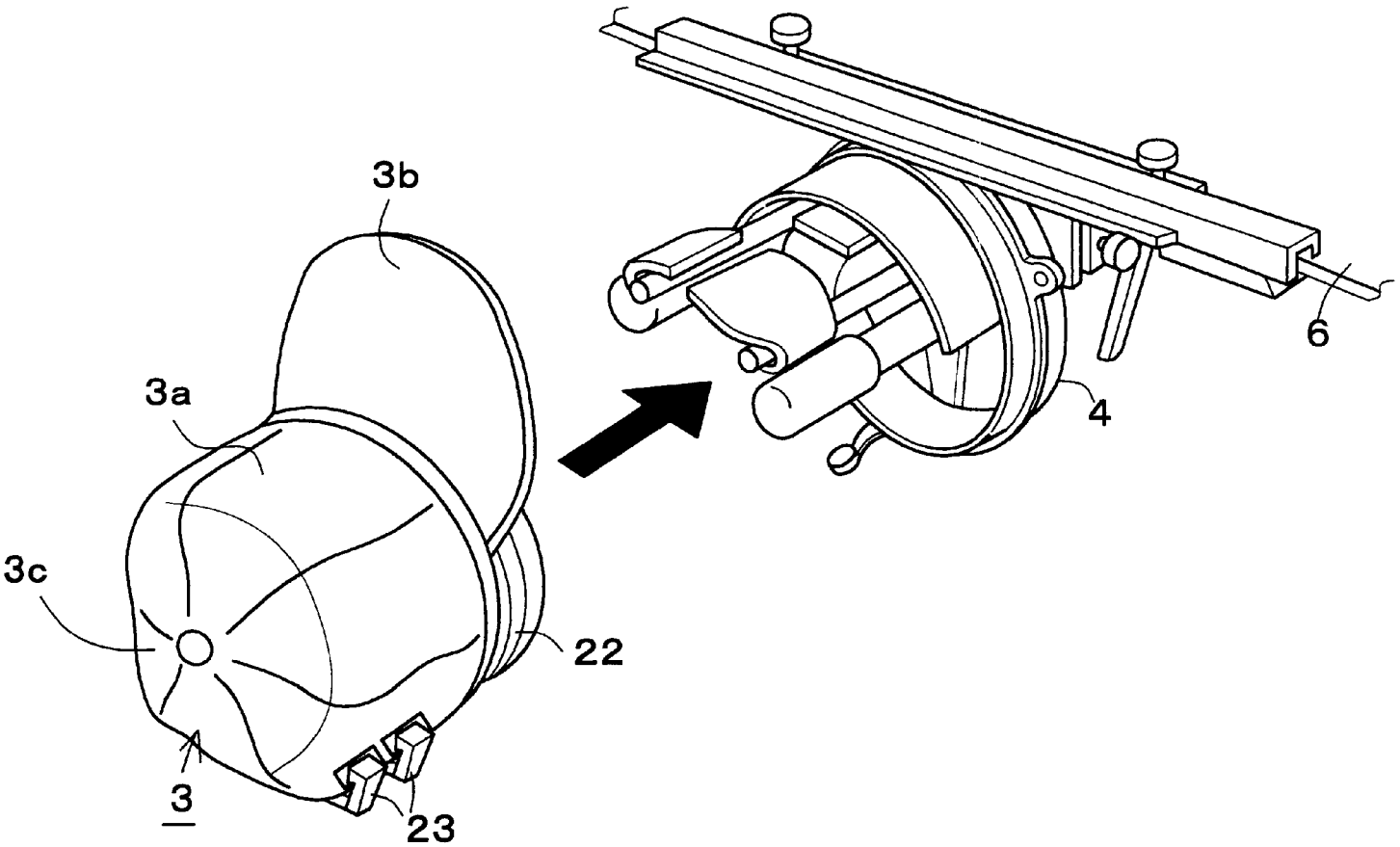
FIG. 2 is a perspective view of an exemplary embodiment of a cap frame and a cap to be attached to an attachment frame.
Figure 3:
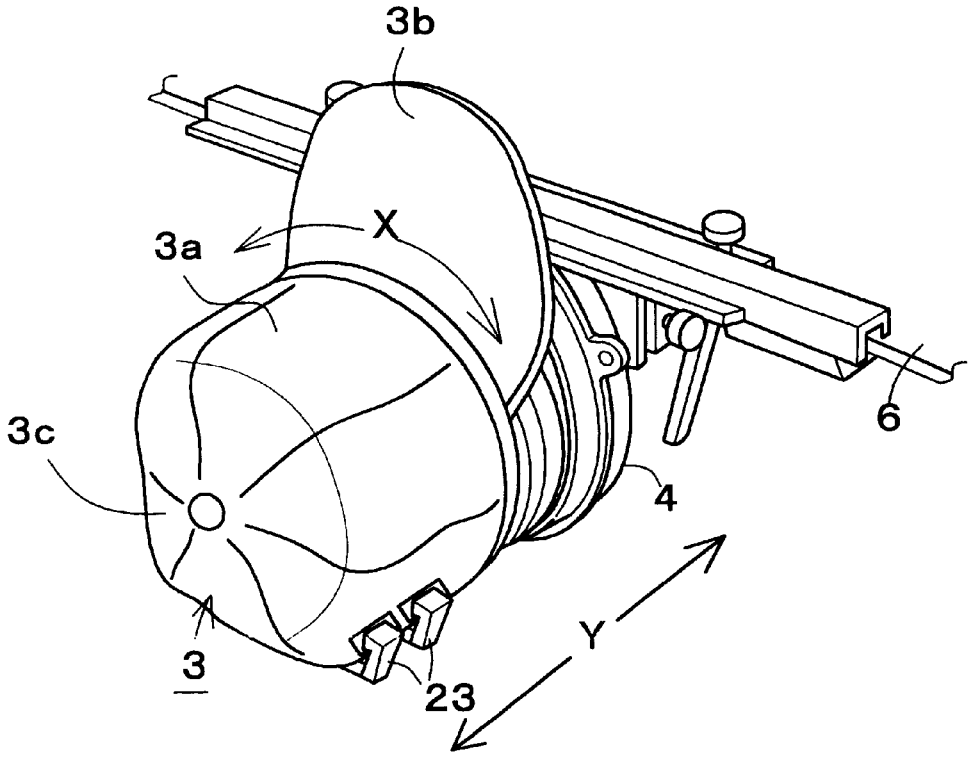
FIG. 3 is a perspective view showing the cap frame and the cap of FIG. 2 attached to the attachment frame.

FIG. 2 shows the attachment frame 4 provided on the X-Y carriage 6, a cap frame 22 detachably attached to the attachment frame 4, and the cap 3 to be put on the cap frame 22, in a perspective view. The cap 3 is fixed to the cap frame 22 with clips 23 so as to face the front of the cap 3 up. With the cap 3 fixed in this manner, the cap frame 22 is attached to the attachment frame 4, and the cap 3 is attached to the attachment frame 4 as shown in FIG. 3. When the X carriage 20 is driven, the cap 3 is rotated in the X direction indicated by letter X and arrows at each side in FIG. 3. Similarly, the cap 3 is moved in the Y direction indicated by letter Y and arrows at each side in FIG. 3. In this embodiment, through the up and down movement of the needle bar 2 and the movement of the attachment frame 4 to which the cap 3 is attached in the X and Y directions, a pattern is embroidered on the front of the cap 3 in the direction from the visor 3*b* toward the crown 3*c*.

Next, electrical and mechanical structures of the sewing system 1 will now be described with reference to the flowchart in FIG. 4. A driving mechanism 24 of the sewing system 1 comprises a machine motor 27, an X pulsemotor 28, a Y pulsemotor 29, and a thread trimming solenoid 30.

A main shaft 31 connected to the machine motor 27 is linked to a needle bar up and down moving mechanism 34. The needle bar up and down moving mechanism 34 is connected to each needle bar 2 provided on the arm 8.

The needle bar up and down moving mechanism 34 converts a rotational movement of the main shaft 31 into a reciprocating movement in the vertical direction and transmits it to each needle bar 2. Therefore, when the main shaft 31 rotates, a needle (not shown) attached to the needle bar 2 is moved up and down so that it penetrates the material.

The X pulsemotor 28 is connected to the X carriage 20 via an X direction moving mechanism 35. The X direction moving mechanism 35 is driven to move by the X pulsemotor 28. Therefore, the X carriage 20 is operated and the attachment frame 4 supporting the cap 3 is moved and rotated in the X direction as shown in FIG. 3.

The Y pulsemotor 29 is connected to the Y carriage 21 via a Y direction moving mechanism 36. The Y carriage 21 is provided so as to move in the Y direction in regard to the X carriage 20. The Y direction moving mechanism 36 is driven to move by the Y pulsemotor 29. Therefore, the Y carriage 21 is operated, so that the attachment frame 4 supporting the cap 3 is moved in the Y direction as shown in FIG. 3.

The thread trimming solenoid 30 is connected to a thread trimming mechanism 37 that cuts threads at the end of sewing.

The computer 41 comprises a central processing unit (CPU) 42, a read-only memory (ROM) 43, a random-access memory (RAM) 44, an input interface 45 and an output interface 46. The ROM 43 stores a predetermined program such as the control program in advance. The RAM 44 stores a result calculated by the CPU 42 temporarily. The CPU 42 controls the driving mechanism 24 in accordance with the control program based on each signal inputted through the input interface 45. The machine motor 27, the pulsemotors 28, 29, the solenoid 30, and the display 16 are connected to the output interface 46 via a plurality of drive circuits 49 to 53. The keyboard 15, the power switch 17, and the floppy disk drive 19 are connected to the input interface 45.

The computer 41 (CPU 42) orders the display 16 to display a plurality of embroidery patterns when the embroidery key on the keyboard 15 is pressed. When a pattern is selected using a specified key, the computer 41 reads sewing data corresponding to the pattern from the floppy disk 18 inserted into the floppy disk drive 19, and stores it in the RAM 44. The computer 41 processes the read sewing data according to the control program stored in the ROM 43, to establish a plurality of stitch data.

FIG. 5 shows the sewing data to be stored in the RAM 44. The sewing data includes stitch data each representing a sewing operation for a stitch. Each of stitch data is mainly made up of a combination of the following: one of a plurality of control codes such as a thread trimming code, a stitch code, a feed code, an end code, and a color change code, the X direction movement amount, the Y direction movement amount, a needle number before needle change, and a needle number after needle change. The stitch code is used to move the attachment frame 4 while a stitch is being formed. The feed code is used to move the attachment frame 4 without any stitch formed. The end code is used to indicate the end of sewing. The X direction movement amount represents the amount in which the object to be sewn is moved in the X direction based on the needle. The Y direction movement amount represents the amount in which the object to be sewn is moved in the Y direction based on the needle. The color change code is used to indicate that the needle bar 2 is changed to another one. The needle number before needle change represents the needle number before a needle change (a color change) is made. The needle number after needle change represents the needle number after the needle change is made.

When the correction key on the keyboard 15 is pressed, the computer 41 reads the correction program for correcting the sewing data from another floppy disk 18 inserted into the floppy disk drive 19, and stores it in the RAM 44. The computer 41 corrects the sewing data selected above according to the read correction program, to create execution data that allows the control codes to be executed. In the embodiment, the computer 41 corresponds to a first, second, third devices according to the invented correction apparatus for sewing data. In addition, the floppy disk 18 storing the correction program corresponds to a computer-readable recording medium storing the correction program that allows the computer 41 to execute the correction method for sewing data in the invention.

Figure 6:
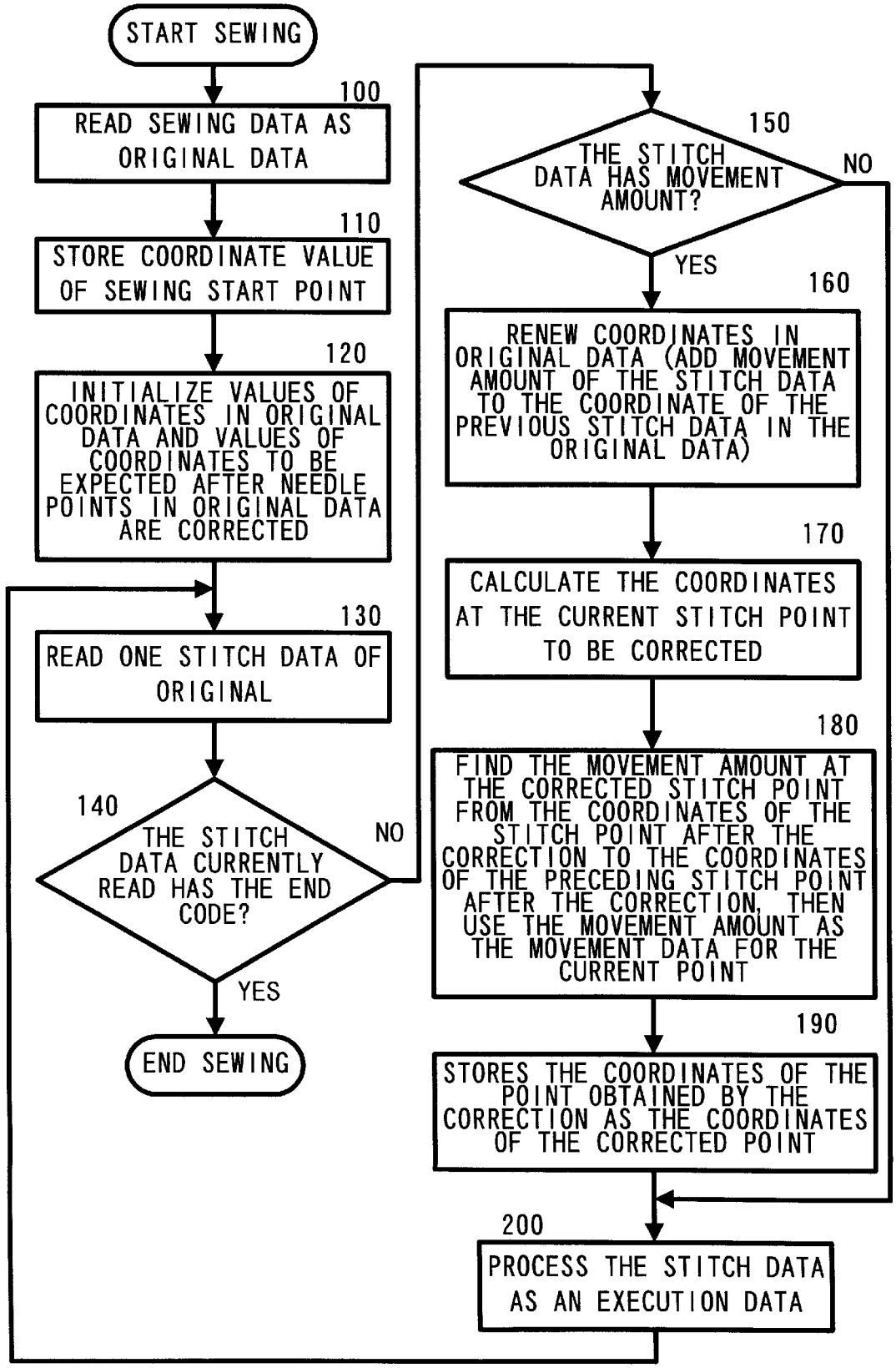
FIG. 6 is a flowchart of an exemplary embodiment of a correction program.
Figure 7:
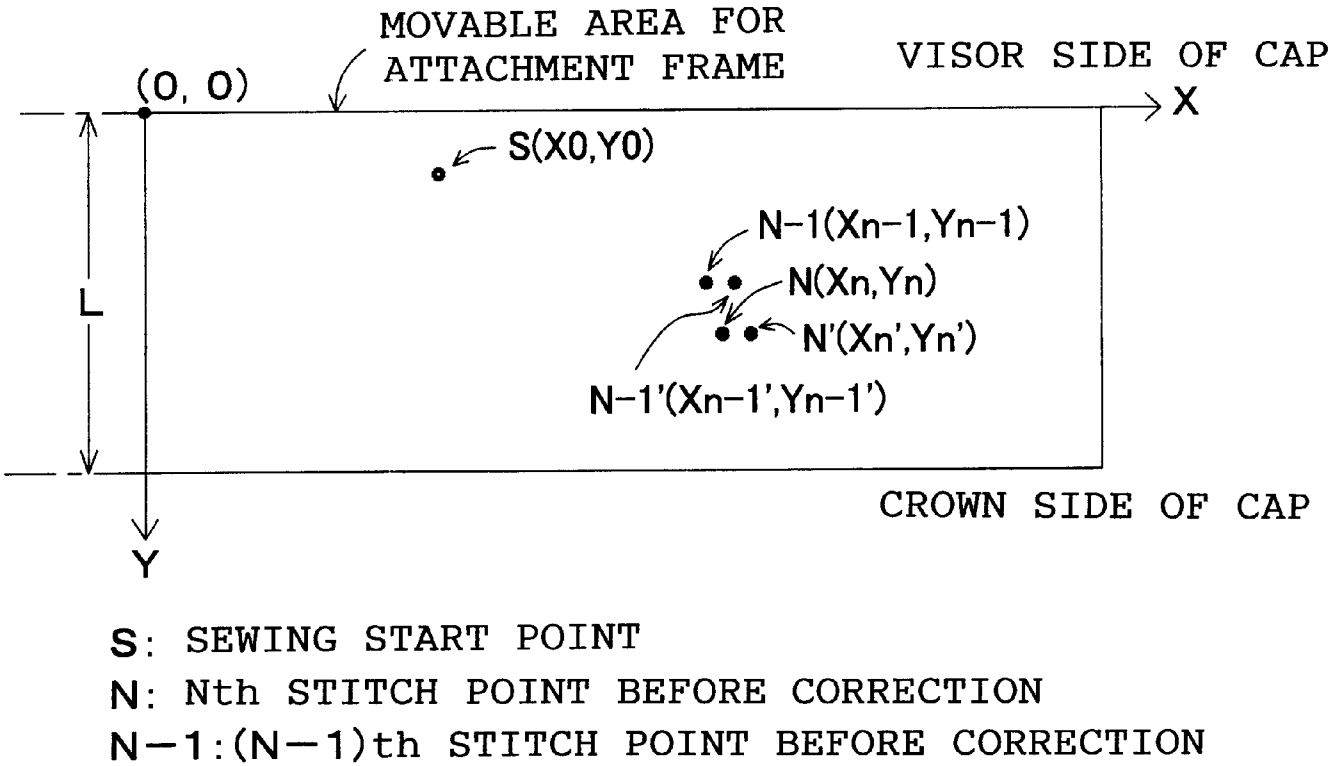
FIG. 7 is an exemplary embodiment of sewing developed on a cap material.
Figure 8:
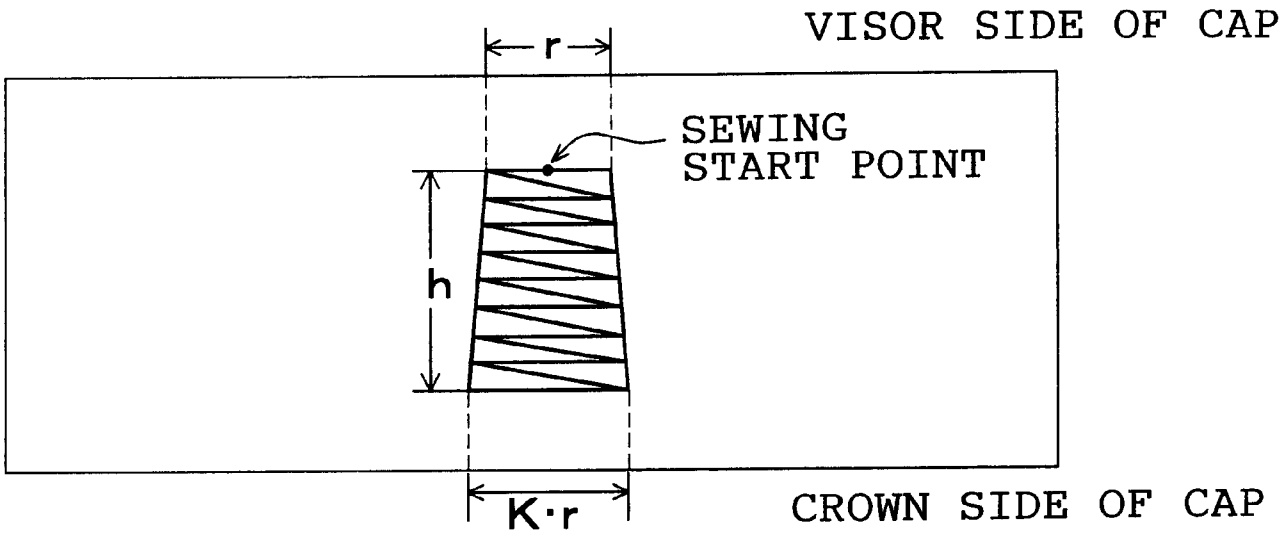
FIG. 8 is an exemplary embodiment of sewing is made on a material for a cap.

The correction method for sewing data, that is the contents of the correction program will now be described with reference to FIGS. 6 to 8. FIG. 6 is a flowchart showing the contents of the correction program. In the flowchart, Si(i=1, 2, 3 . . . ) stands for a procedure step. FIGS. 7 and 8 represent the state of sewing on a material for the cap 3 conceptually. (The material for the cap 3 is indicated in a development elevation as a matter of convenience.)

At S100, the computer 41 reads a sewing data as an original data. The reading here implies the following cases: one is reading a sewing data stored in the floppy disk 18 by means of the floppy disk drive 19 and storing it in an allotted area in the RAM 44; and the other is reading a sewing data stored in the allotted area in the RAM 44 as the original data and storing it in another allotted area in the RAM 44. In the embodiment, the process at S100 corresponds to a reading step of the invention, and the computer 41 that executes the process at S100 corresponds to a first device of the invention.

At S110, the computer 41 extracts a sewing start point from the read original data and stores it in an allotted area in the RAM 44. That is, as shown in FIG. 7, it stores the x and y coordinates (X0, Y0) of the sewing start point S.

At S120, the computer 41 initializes the values of the coordinates of all stitch points in the original data and the values of the coordinates to be expected after the stitch points in the original data are corrected. That is, the coordinates of the sewing start point S are initialized.

At S130, the computer 41 reads one stitch data from the original data. FIG. 5 shows the contents of sewing data in which each stitch data that is read in sequence is arranged.

At S140, the computer 41 determines whether the stitch data currently read has the end code. When the stitch data has the end code, the computer 41 finishes sewing. When the data does not have the end code, the computer 41 shifts to S150.

At S150, the computer 41 determines whether the stitch data currently read includes a data representing a movement amount. Namely, it determines whether there is a stitch code or feed code as shown in FIG. 5. When the stitch data does not include any movement amount, the computer 41 shifts to S200.

At S200, the computer 41 processes the stitch data currently read as the execution data, and shifts to S130. In other words, the computer 41 controls the sewing system 1 based on the stitch data, to execute sewing for a stitch.

On the other hand, when the stitch data currently read includes the movement amount at S150, the computer 41 renews the coordinates of the stitch data in the original data at S160. Namely, the computer 41 adds the movement amount of the stitch data to the coordinates of the preceding stitch data in the original data, so as to renew the coordinates of the stitch data before a correction is made. For example, if the stitch data represents the stitch point numbered N from the sewing start point S as shown in FIG. 7, the movement amount of the stitch data is added to the coordinates (Xn−1, Yn−1) of the preceding stitch point numbered (N−1), to find the coordinates (Xn, Yn) of the Nth stitch point. In the embodiment, steps S130 to S160 correspond to a calculating step of the invention, and the computer 41 that executes steps S130 to S160 corresponds to a second device of the invention.

At S170, the computer 41 calculates the coordinates of the stitch point to be corrected, different from the original data. In other words, the computer 41 finds the coordinates (Xn', Yn') of the point N' that is found after the stitch point N is corrected, as shown in FIG. 7. The computer 41 calculates the coordinates (Xn', Yn') of the stitch point N' using the following formulas:

$$Xn'=X0+(1+(K-1)\times Yn/L)\times(Xn-X0) \quad (1)$$

$$Yn'=Yn \quad (2)$$

Wherein L stands for an area size in which the attachment frame 4 is movable in the Y direction, and K stands for a correction parameter (a variable that can be changed according to the shape of the cap 3 when K is equal and greater than 1). In the embodiment, an operator can change the correction parameter K through the operation from the keyboard 15.

In the embodiment, the value for Xn, which is the X coordinate of the stitch point N found at 160, is corrected to Xn' based on a correction value which varies according to the value for Yn, which is the Y coordinate of the stitch point N. In this manner, Xn' that is an execution data different from the original data, is formed.

The correction value, as is apparent from the above formulas (1) and (2), is found using the Y coordinate Yn as a variable, and the correction parameter K that can be changed as a constant. In the embodiment, the process at S170 corresponds to a correcting step of the invention. The computer 41 that executes the process at S170 corresponds to a third device of the invention.

At S180, the computer 41 finds the movement amount of the stitch point corrected using the coordinates of the stitch point after the correction and the coordinates of the preceding stitch point after the correction. Then it uses the movement amount as the movement data for the corrected stitch point. In other words, as shown in FIG. 7, the movement amount between the corrected preceding stitch point (N−1)' and the corrected stitch point N' is used as the movement data for the corrected stitch point.

At S190, the computer 41 stores the coordinates of the point obtained by the correction as the coordinates of the corrected point in the RAM 44.

At S200, the computer 41 processes the corrected stitch data as execution data, and shifts to S130. Namely, the computer 41 controls the sewing system 1 based on the corrected stitch data, to execute sewing for a stitch.

Then, repeating processes at S130 to S200, the computer 41 executes sewing each stitch after correcting each stitch data having a movement amount with respect to all stitch data included in the sewing data which is read as the original data at S100.

FIG. 8 conceptually shows a result of sewing after the above correction is made. When a quadrangle such as a rectangle or a square having a width "r" in the X direction and a length "h" in the Y direction, is sewn after the correction, the finished pattern becomes a trapezoid as shown in FIG. 8. As the sewing is proceeded from the visor side 3*b* of the cap 3 to the crown side 3*c*, the movement amount from the sewing start point becomes larger in the Y direction. Namely, the attachment frame 4 is moved more widely toward the crown side 3*c* so that the movement amount of the X direction gradually becomes larger than the width "r" of the original data.

According to the correction apparatus and the correction method for the sewing data in the embodiment as described above, the sewing data is read as the original data by the computer 41. The coordinates of each stitch point, that is, the coordinates of the stitch point N (Xn, Yn) are found from the original data. The value for the X coordinate Xn of the stitch point N, is corrected based on the correction value which varies according to the value for the Y coordinate Yn of the stitch point N. As a result, the execution data is formed, differently from the original data. In other words, the coordinates of N (Xn, Yn) are corrected in accordance with the formulas (1) and (2), and the coordinates of N'(Xn', Yn') obtained after the correction are accomplished as the execution data. Based on the execution data, the sewing system 1 allows the sewing machine 7 to embroider a pattern corresponding to the trapezoid as shown in FIG. 8.

Because the cap 3 is substantially conical, the movement amount of the X direction at the crown side becomes smaller than that at the visor side. In this case, the formation of the execution data due to the correction as described above acts effectively. In addition, when the cap 3 is moved along with the attachment frame 4 under the situation that only the visor side 3*b* of the cap 3 is fixed to the attachment frame 4, the movement amount of the cap 3 in the X direction at the crown side 3*c* of the Y direction may become inferior to that at the visor side 3*b*. In this case, the formation of the execution data due to the correction as described above acts effectively. In other words, correcting the X coordinate Xn of the stitch point N (Xn, Yn) based on the correction value enables substantially equal movement amounts in the X-direction at the crown side 3*b* and the visor side 3*c* and equal displacements at the crown side 3*b* and the visor side 3*c* with respect to the attachment frame 4. As a result, an embroidery pattern can be embroidered on the cap 3 as the same as the original data indicates, unaffected by the shape of the cap 3 and the different movement amounts between the crown side 3*b* and the visor side 3*c*. Namely, as distinct from the conventional sewing machine, the sewing system 1 can prevent an undesired event that when an embroidery pattern is embroidered on the cap, the width of the embroidered portion at the crown side 3*b* becomes smaller than that at the visor side 3*c* contrary to the expected pattern.

The formulas (1) and (2) are used to correct the original data. For example, when the center of the X axis positioned at the edge of the visor 3*b* of the cap 3 is regarded as A (0, 0), the coordinates of N (Xn, Yn) of the embroidery pattern can be expressed as follows as a result of the correction:

$$\{((Yn/L)\times(K-1)+1)Xn,\ Yn\} \tag{3}$$

As is apparent from the above formula (3), it is found that the correction value for Xn, that is ((Yn/L)×(K−1)+1), increases as the value for Yn increases. In addition, the change ratio of the correction value that varies with the increase of Yn is changed in accordance with the change of the correction parameter K. Because the correction parameter K can be changed through the operation of the keyboard 15, the sewing data can be corrected in consideration of the shape of the cap 3.

The correction program stored in the floppy disk 18 is read and executed by the computer 41, and the above-mentioned correction method for the sewing data is executed. Because only the correction program can be stored in the floppy disk 18, it can be read on each of a plurality of sewing systems 1.

Although in the above embodiment, the invention is embodied in the sewing system for embroidery 1 having one sewing machine 7, it should be appreciated that the invention may be embodied in multiple head sewing system having a plurality of sewing machines.

Although in the above embodiment, the invention is embodied in case of sewing the cap 3 as the object to be sewn, it should be appreciated that the invention may be embodied in case of sewing something having a three-dimensional shape other than the cap 3, such as a bag.

Although in the above embodiment, the computer 41 reads the correction program stored in the floppy disk 18 therefrom, it should be appreciated that the correction program may be stored in advance in the ROM 43 of the computer 41.

Although in the embodiment, the floppy disk 18 is used as a computer-readable recording medium storing an execution program that allows the computer 41 to perform the correction method for the sewing data, it should be appreciated that other medium may be used. A CD-ROM and a ROM card may be used as the recording medium.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A correction apparatus for sewing data to be used on a sewing machine that forms a sewing pattern, that includes stitch points, on an object to be sewn by moving a needle up and down and a frame to which the object is attached in X- and Y-axis directions, comprising:

a first device that reads the sewing data as original data, the sewing data including X-axis direction movement data and Y-axis direction movement data;

a second device that calculates X-axis coordinate data and Y-axis coordinate data of each stitch point based on the original data; and a third device that corrects the X-axis coordinate data based on a correction value, the correction value varying according to the Y-axis coordinate data of the stitch point.

2. The correction apparatus according to claim 1, wherein the correction value is calculated using the Y-axis coordinate data as a variable and a correction parameter as a constant.

3. The correction apparatus according to claim 2, wherein the correction parameter can be changed according to a shape of the object to be sewn.

4. The correction apparatus according to claim 2, wherein the corrected coordinates Xn' and Yn' of an N'th stitch point are defined as:

$$Xn'=X0+(1+(K-1)\times Yn/L)\times(Xn-X0) \text{ and}$$

Yn'=Yn, wherein X0 is a starting coordinate of the original data, K is the correction parameter, Xn and Yn are coordinates of an Nth stitch point of the original data, and L is the size of an area in which the frame is movable in the Y-axis direction.

5. A correction apparatus for sewing data to be used on a sewing machine, including a bed, that forms a pattern, that includes stitch points, on a cap in a direction from a visor side to a crown side by moving a needle up and down and a frame to which the cap is attached in X- and Y-axis directions, comprising:

a first device that reads the sewing data as original data, the sewing data including X-axis direction movement data and Y-axis direction movement data, the Y-axis being in a direction of the length of the bed and the X-axis direction being a rotating direction on the Y-axis;

a second device that calculates X-axis coordinate data and Y-axis coordinate data of each stitch point based on the original data; and a third device that corrects the X-axis coordinate data based on a correction value, the correction value varying according to the Y-axis coordinate data of the stitch point.

6. The correction apparatus according to claim 5, wherein the correction value is calculated using the Y-axis coordinate data as a variable and a correction parameter as a constant.

7. The correction apparatus according to claim 6, wherein the correction parameter can be changed according to a shape of the cap.

8. The correction apparatus according to claim 6, wherein the corrected coordinates Xn' and Yn' of an N'th stitch point are defined as:

$$Xn'=X0+(1+(K-1)\times Yn/L)\times(Xn-X0) \text{ and}$$

Yn'=Yn, wherein X0 is a starting coordinate of the original data, K is the correction parameter, Xn and Yn are coordinates of an Nth stitch point of the original data, and L is the size of an area in which the frame is movable in the Y-axis direction.

9. A correction method for sewing data to be used on a sewing machine that forms a pattern, that includes stitch points, on an object to be sewn by moving a needle up and down and a frame in X- and Y-axis directions, comprising:

reading the sewing data as original data, the sewing data including X-axis direction movement data and Y-axis direction movement data;

calculating X-axis coordinate data and Y-axis coordinate data of each stitch point based on the original data; and correcting the X-axis coordinate data based on a correction value, the correction value varying according to the Y-axis coordinate data of the stitch point.

10. The correction method according to claim 9, wherein the correction value is calculated using the Y-axis coordinate data as a variable and a correction parameter as a constant.

11. The correction method according to claim 10, wherein the correction parameter can be changed according to a shape of the object to be sewn.

12. The correction method according to claim 10, wherein the corrected coordinates Xn' and Yn' of an N'th stitch point are defined as:

$$Xn'=X0+(1+(K-1)\times Yn/L)\times(Xn-X0) \text{ and}$$

Yn'=Yn, wherein X0 is a starting coordinate of the original data, K is the correction parameter, Xn and Yn are coordinates of an Nth stitch point of the original data, and L is the size of an area in which the frame is movable in the Y-axis direction.

13. A computer-readable recording medium that stores a program to allow a computer to execute a correction method for sewing data to be used on a sewing machine that forms a pattern, that includes stitch points, on an object to be sewn by moving a needle up and down and a frame to which the object is attached in X- and Y-axis directions, the correction method comprising:

reading the sewing data as original data, the sewing data including X-axis direction movement data and Y-axis direction movement data;

calculating X-axis coordinate data and Y-axis coordinate data of each stitch point based on the original data; and correcting the X-axis coordinate data based on a correction value, the correction value varying according to the Y-axis coordinate data of the stitch point.

14. The computer-readable recording medium of claim 13, wherein the correction value is calculated using the Y-axis coordinate data as a variable and a correction parameter as a constant.

15. The computer-readable recording medium of claim 14, wherein the correction parameter can be changed according to a shape of the object to be sewn.

16. The computer-readable recording medium of claim 14, wherein the corrected coordinates Xn' and Yn' of an N'th stitch point are defined as:

$$Xn'=X0+(1+(K-1)\times Yn/L)\times(Xn-X0) \text{ and}$$

Yn'=Yn, wherein X0 is a starting coordinate of the original data, K is the correction parameter, Xn and Yn are coordinates of an Nth stitch point of the original data, and L is the size of an area in which the frame is movable in the Y-axis direction.

* * * * *